US009004585B1

(12) United States Patent
Pidgornyy

(10) Patent No.: US 9,004,585 B1
(45) Date of Patent: Apr. 14, 2015

(54) CONVERTIBLE CHAIR SOFA CONFIGURATION

(71) Applicant: Volodymyr Pidgornyy, Toronto North York (CA)

(72) Inventor: Volodymyr Pidgornyy, Toronto North York (CA)

( * ) Notice: Subject to any disclaimer, the term of this patent is extended or adjusted under 35 U.S.C. 154(b) by 55 days.

(21) Appl. No.: 13/912,319

(22) Filed: Jun. 7, 2013

Related U.S. Application Data

(60) Provisional application No. 61/657,283, filed on Jun. 8, 2012.

(51) Int. Cl.
*A47B 85/04* (2006.01)
*A47C 13/00* (2006.01)

(52) U.S. Cl.
CPC ..... *A47C 13/005* (2013.01)

(58) Field of Classification Search
CPC ..... B64D 11/60; B64D 2011/0682; B64D 2011/062; B64D 2011/0613
USPC ..... 297/118, 127, 120, 130, 411.2, 411.46, 297/411.32, 440.12, 411.24, 440.1, 440.22, 297/440.23; 5/12.2, 52, 285, 41, 47, 38
See application file for complete search history.

(56) References Cited

U.S. PATENT DOCUMENTS

| | | | | |
|---|---|---|---|---|
| 2,348,407 | A * | 5/1944 | O'Neill | 297/67 |
| 3,030,146 | A * | 4/1962 | Faxon | 297/411.45 |
| 3,380,777 | A * | 4/1968 | Bennett | 297/440.22 |
| 3,547,487 | A * | 12/1970 | Shankman | 297/111 |
| 3,608,959 | A * | 9/1971 | Sarvas | 297/218.3 |
| 4,523,787 | A * | 6/1985 | Robinson | 297/440.2 |
| 5,263,764 | A * | 11/1993 | Laughlin et al. | 297/440.23 |
| 6,241,317 | B1 * | 6/2001 | Wu | 297/440.23 |
| 6,267,446 | B1 * | 7/2001 | Wieland et al. | 297/440.13 |
| 6,981,747 | B2 * | 1/2006 | Wieland et al. | 297/440.11 |
| 7,020,911 | B2 * | 4/2006 | Oldham | 5/12.2 |

* cited by examiner

*Primary Examiner* — Chi Q Nguyen
(74) *Attorney, Agent, or Firm* — Harpman & Harpman

(57) ABSTRACT

Multiple convertible furniture configurations adapted to provide multiple seating surfaces by interchangeable and removable support cushion units inclusive in a single furniture element. Removably self-supporting cushion seat assemblies are selectively secured to a primary furniture element as auxiliary arms and back surfaces, each of which has internally deployable support legs allowing cushion seat assemblies to be used independently wherein combination with the original chair sofa support unit increasing the number of seating surfaces and arrangement possible.

12 Claims, 9 Drawing Sheets

CONVERTIBLE CHAIR SOFA CONFIGURATION

This application claims the benefit of U.S. Provisional Application No. 61/657,283, filed Jun. 8, 2012.

BACKGROUND OF THE INVENTION

1. Technical Field

This invention relates to convertible furniture that can be reconfigured to form different furniture configurations together or specifically from the base furniture element.

2. Description of Prior Art

Prior art devices of this type can be seen in the following U.S. Pat. Nos.; 2,751,971, 4,297,752, 4,366,585, 7,020,911 and U.S. Publication 2011/001166262.

In U.S. Pat. No. 2,751,971, a detachable inside arm rest for a sofa bed can be seen having oppositely disposed arm rests with a support attachment bracket which can be removed.

U.S. Pat. No. 4,297,752 illustrates a convertible furniture article in which the back rest and arm rest can be moved for conversion into a daybed.

U.S. Pat. No. 4,366,585 is directed to an arm chair transformable into a bed having multiple boxed structures telescopically configured for expansion into a sleeping surface.

U.S. Pat. No. 7,020,911 claims a convertible furniture element having multiple removable arms, backs and seat cushions.

U.S. Publication 2011/001166262 shows a sofa bed in which the armrest and back rest portion can be placed in multiple positions changing the configuration thereof into a bed surface.

SUMMARY OF THE INVENTION

A self-contained chair and sofa seating configuration having a plurality of selectively secured cushion seats therewithin and thereon. Single chairs, sofa embodiment functions can afford multiple deploying useful seating configurations in which cushion seats having folded legs can be set up independently of the storage support chair/sofa unit by emulating a chair/sofa arms and back cushions while being removable for use.

DETAILED DESCRIPTION OF THE INVENTION

Figure 1:
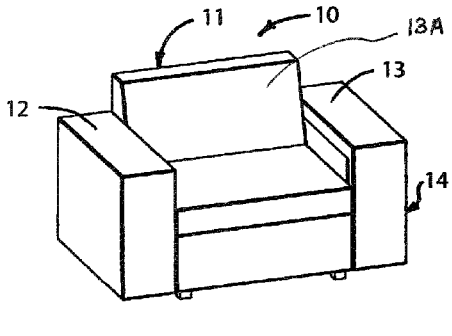
FIG. 1 is a front perspective view of the primary chair configuration of the invention.
Figure 2:
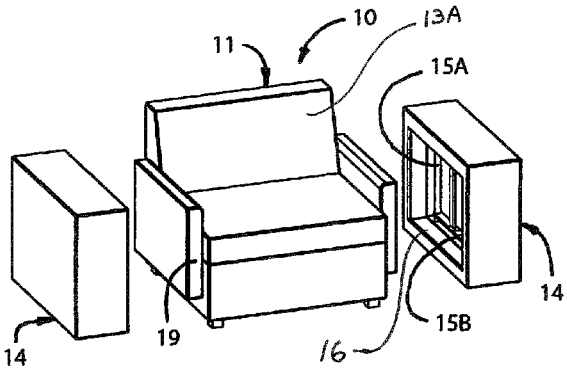
FIG. 2 is a front exploded perspective view thereof.
Figure 3:
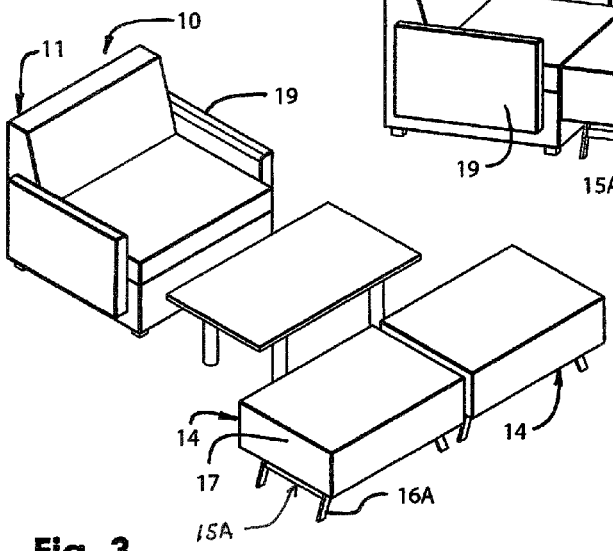
FIG. 3 is a side perspective view with cushion arms detached.
Figure 4:
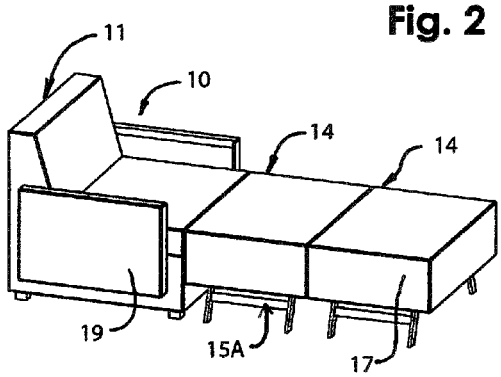
FIG. 4 is a side perspective view of an alternate use arrangement.
Figure 5:
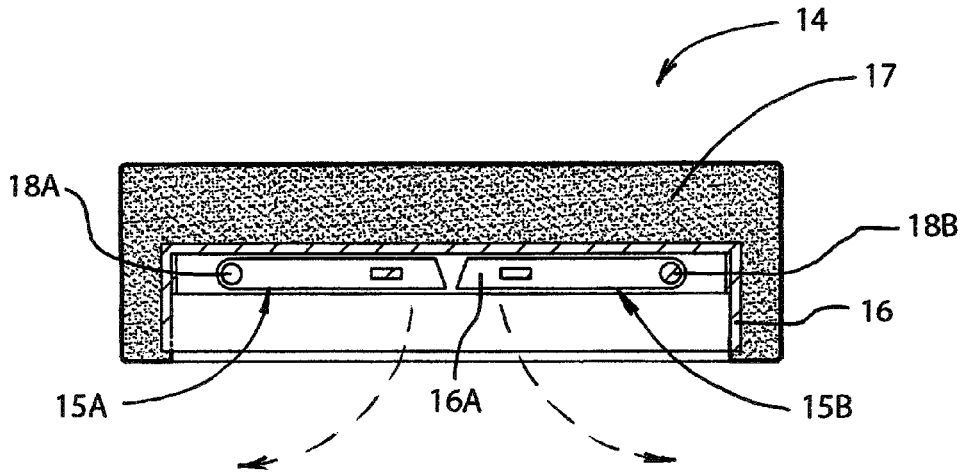
FIG. 5 is a cross section view of a detached cushion seat assembly.
Figure 6:
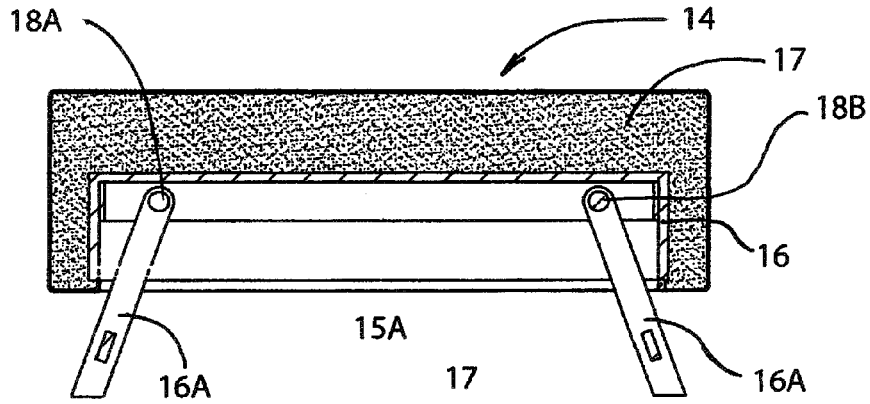
FIG. 6 is a cross-sectional view thereof with legs deployed.
Figure 7:
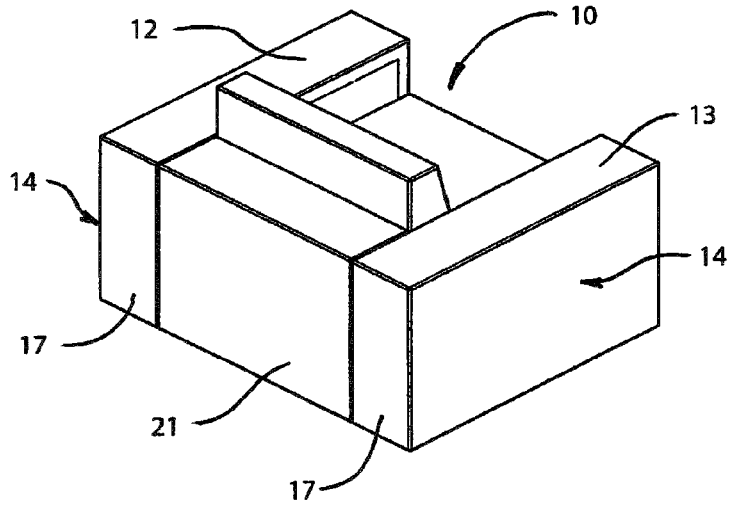
FIG. 7 is a rear perspective view of a first alternate chair conversion of the invention.
Figure 8:
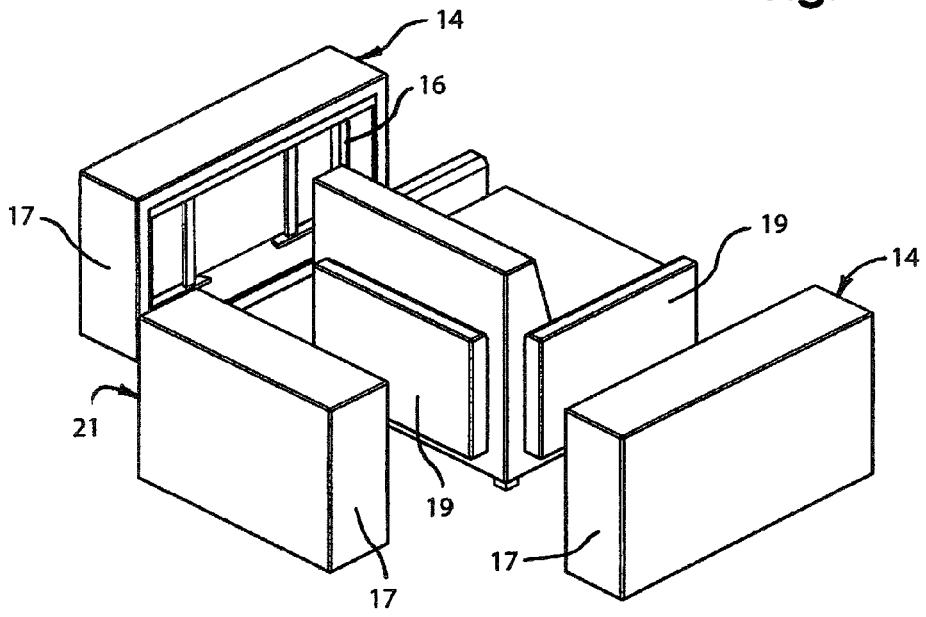
FIG. 8 is a rear exploded perspective view thereof.
Figure 9A:
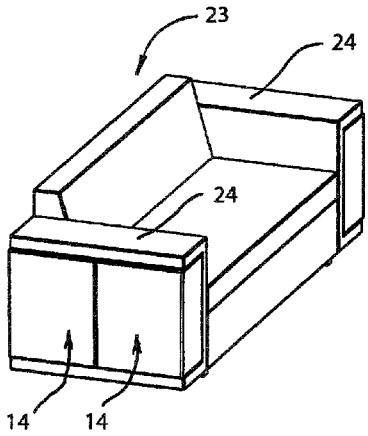
FIGS. 9A and 9B are a composite front perspective view of a conversion sofa with a cushion seat arm insert in stowed and deployed position with an auxiliary table illustrated.
Figure 9B:
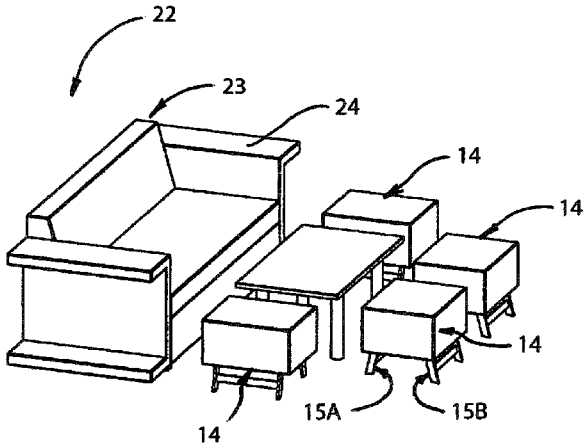
Figure 10A:
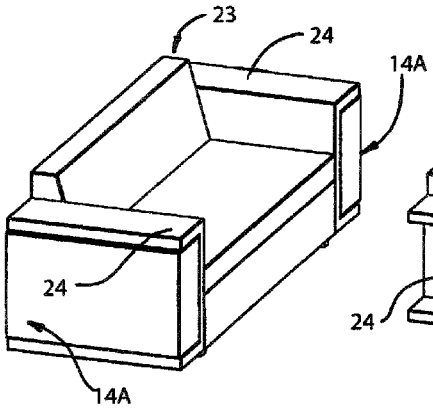
FIGS. 10A and 10B are a composite front view of a first alternate cushion seat armrest configuration as seen therein.
Figure 10B:
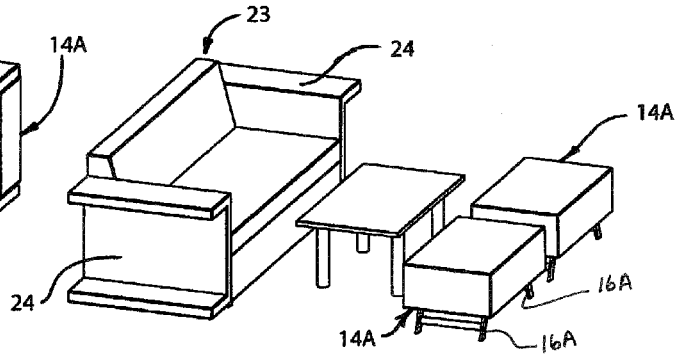
Figure 11:
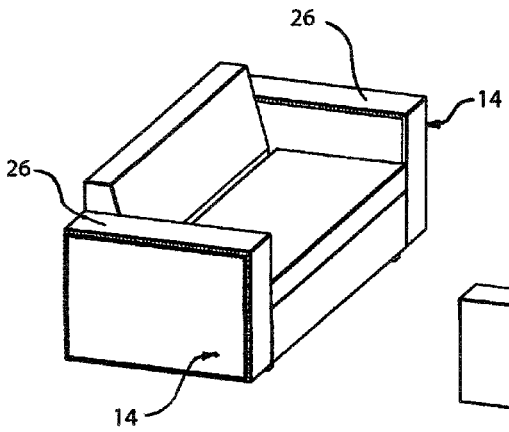
FIG. 11 is a front perspective view of a second alternate cushion seat armrest configuration.
Figure 12:
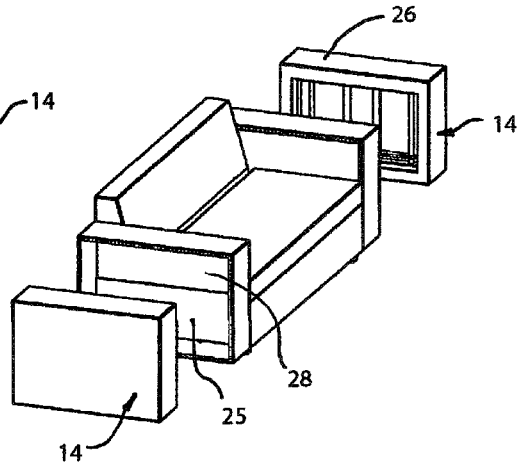
FIG. 12 is a front perspective view thereof in open deployed position.

Referring to FIGS. 1-4 of the drawings, a primary basic chair form 10 of the invention can be seen having a chair 11, with oppositely disposed cushion side arms 12 and 13 and having an upstanding back cushion 13A. Each of the cushion side arms 12 and 13 function as independent removable cushion seats 14 having a pair of foldable leg assemblies 15A and 15B, best seen in FIGS. 5 and 6 of the drawings. Each cushion seat 14 has a support frame 16 with a cushion 17 extending thereover. The respective leg assemblies 15A and 15B having a pair of leg elements 16A with an interconnecting cross support at 17. The leg elements 16A are pivotally secured by respective pivots 18A and 18B shown folded position in FIG. 5 of the drawings and pivoted open support position in FIG. 6 of the drawings. The cushion seats 14 are supported on the chair by a support frame 19 secured to the chair along each cushion seat to be fitted thereover in frictional registration and held thereon acting as chair arms as seen in FIG. 1 of the drawings until removed and unfolded for independent use as seen in FIGS. 3 and 4 of the drawings. A first alternate form of the chair 10' of the invention can be seen in FIGS. 7 and 8 of the drawings wherein a cushion seat back 21 is added for use as seen in partial deployment in FIG. 8 of the drawings.

Referring now to composite FIGS. 9A, 9B, 10A, and 10B the first of five alternate sofas 22 of the invention can be seen wherein a sofa 23 has oppositely disposed side arms 24, each with a pair of independent cushion seats 14, as hereinbefore described, positioned there within. A single cushion seat 14A in each of said side arms 24 can be seen in FIGS. 10A and 10B of the drawings.

Figure 13:
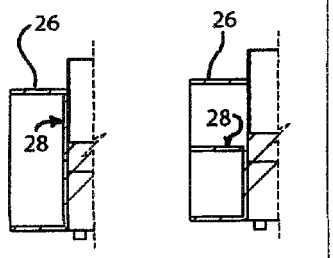
FIG. 13 is a composite side elevational cross-sectional view of a third alternate armrest cushion seat shelf configuration.
Figure 14:
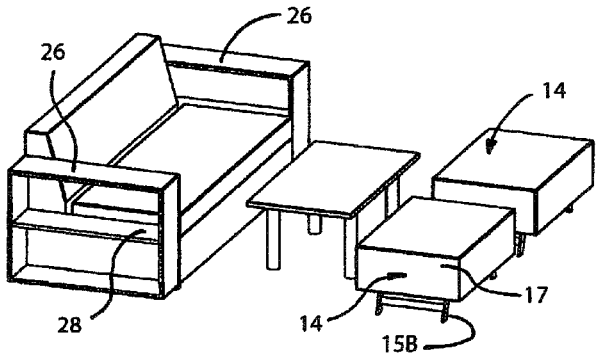
FIG. 14 is a front perspective view thereof in open deployed position.
Figure 15:
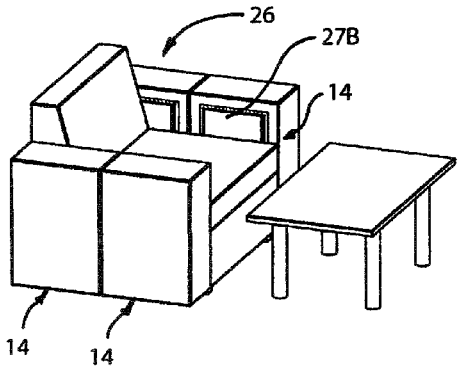
FIG. 15 is a front perspective view of a third alternate form of the chair conversion with slidably disposed arm cushion units.

FIGS. 11-14 illustrate a second alternate form of the sofa configuration, as noted, with the sofa frame 25 having opposing arms 26, each with a removable cushion seat 14. Each of the arms 26 has a hinged shelf 28 oriented therewithin that can be hinged into use position as seen in FIGS. 13 and 14 once the cushion seat 14 have been so removed.

Referring to FIGS. 15-18 of the drawings, a third alternate form sofa configuration 26 can be seen wherein a pair of dual arm supports 27A and 27B provide sliding engagement for a pair of seat cushions 14 respectively thereon.

Figure 16:
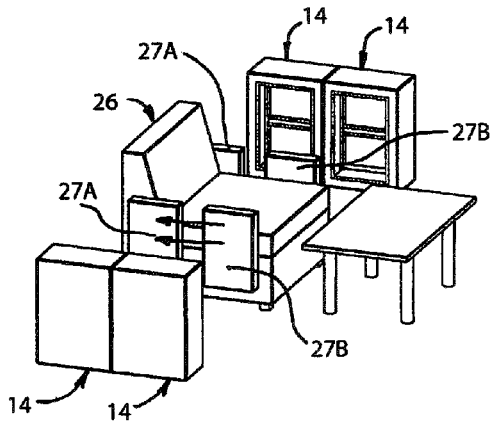
FIG. 16 is a front perspective view thereof in open deployed position.
Figure 17:
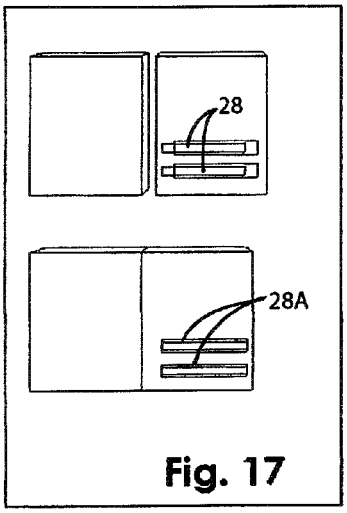
FIG. 17 is a composite side perspective view illustrating slider elements therewithin.
Figure 18:
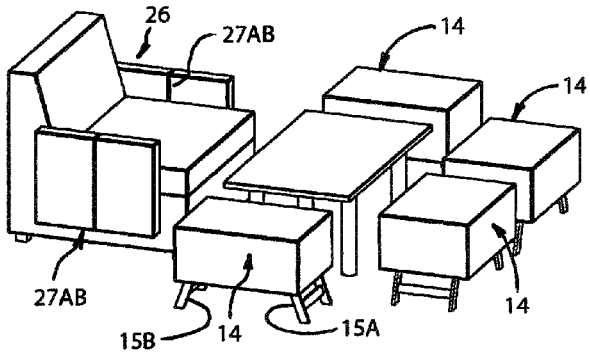
FIG. 18 is a perspective view of the alternate form deployed for use with an illustrated table.

Sliding hardware assemblies 28 and 28A can be seen in composite FIG. 17 of the drawings allowing for trans-lateral sliding deployment and support for the cushion seats 14 there within as will be well understood by those skilled in the art as indicated by directional placement and removal arrows in FIG. 16 of the drawings. It is evident that this assembly allows for the respective cushion chairs 14 to be slidably removed from the respective sliding support assemblies in pair configuration thus supplementing and increase the number of cushion seats 14 capable within a single chair configuration by diminished dimensional considerations.

Figure 19:
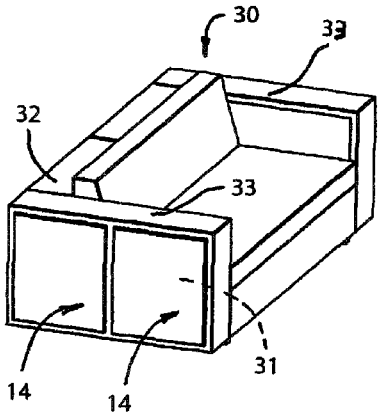
FIG. 19 is a front perspective view of an alternate assembly with multiple stored cushion seats with arms and backs of a sofa with hinged shelves therewith.
Figure 20:
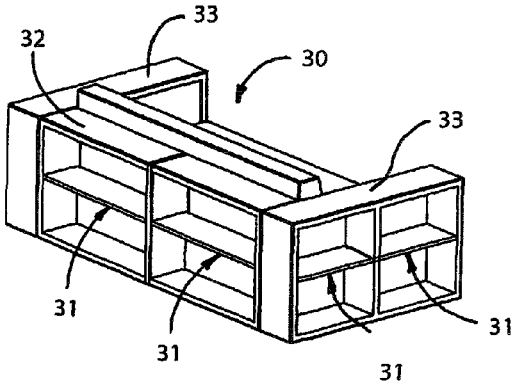
FIG. 20 is a back perspective view thereof with cushion seats removed and shelves hinged in place for use.
Figure 21:
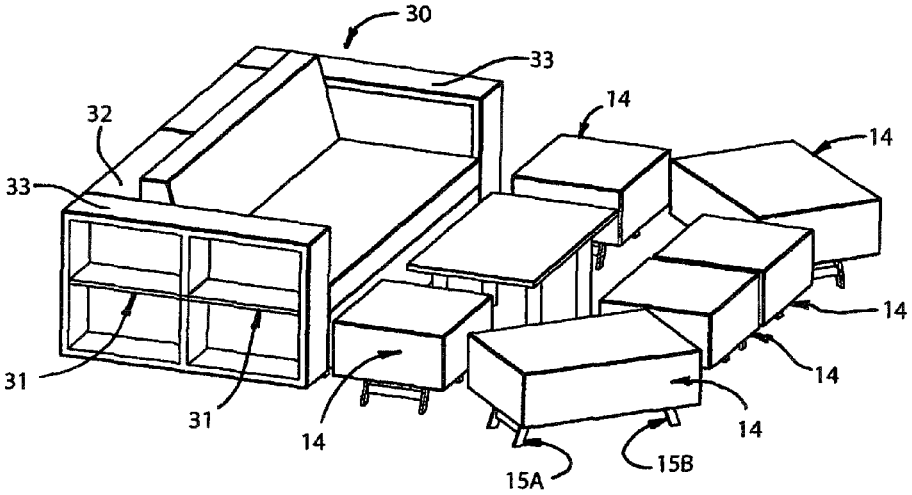
FIG. 21 is a perspective view thereof in deployed used configuration with a table illustration.

FIGS. 19-21 show a fourth alternate form of the sofa configuration 30 in which a seat cushion storage and hinge shelf units 31 have been added to both the back 32 and arms 33 of the basic sofa frame as seen and disclosed in FIGS. 11-14 of the drawings.

Figure 22:
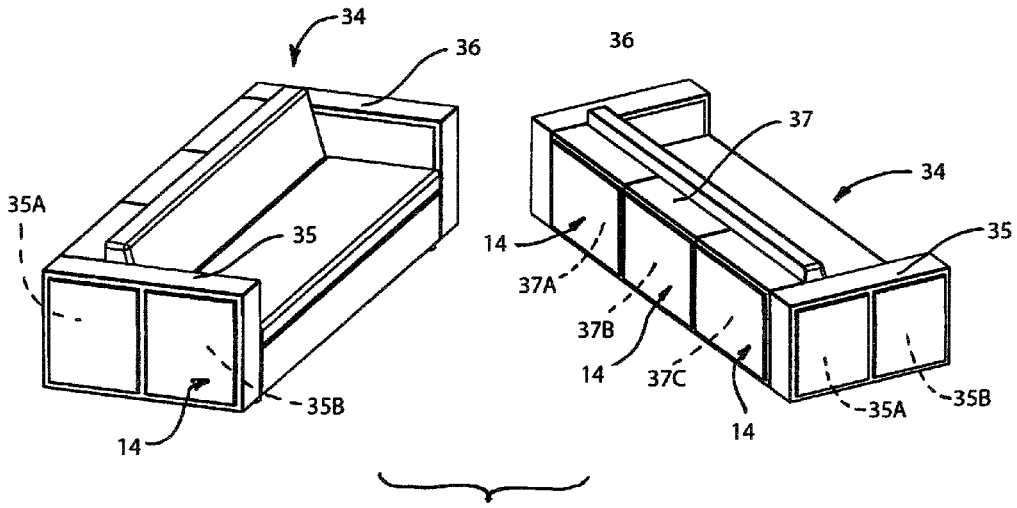
FIG. 22 is a composite perspective view of a second alternate form of the arm and back storage sofa.
Figure 23:
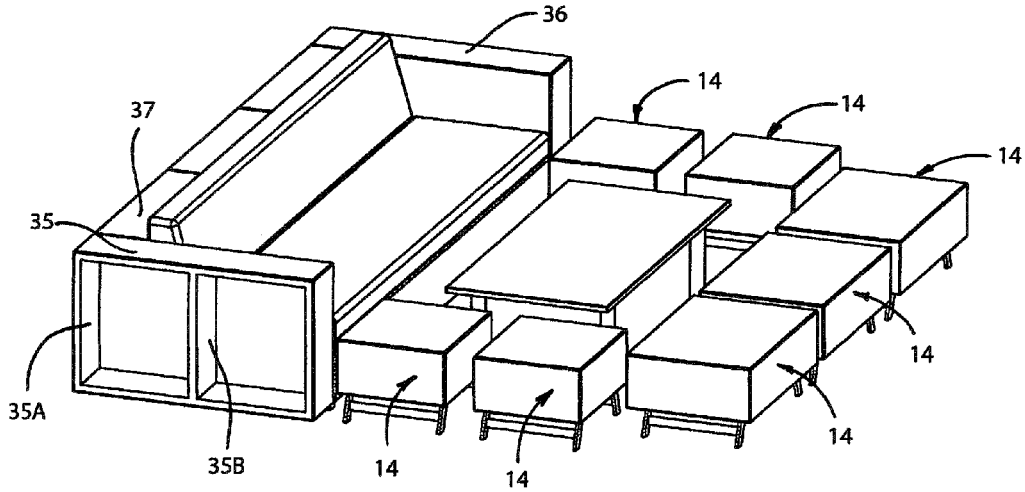
FIG. 23 is a perspective view thereof in deployed use configuration with an illustrated table.

Referring now to FIGS. 22 and 23 of the drawings, a fifth alternate form 34 of the sofa configuration can be seen wherein side arms 35 and 36 and a back 37 have insert openings at 35A, 35B, 37A, 37B, and 37C respectively into which cushion seats 14 are selectively and removably positioned. Once removed, the defined side arms 35 and 36 and back 37 have finished interior openings 35A, 35B, 37A, 37B and 37C in accordance with the style of the furniture.

Figure 24:
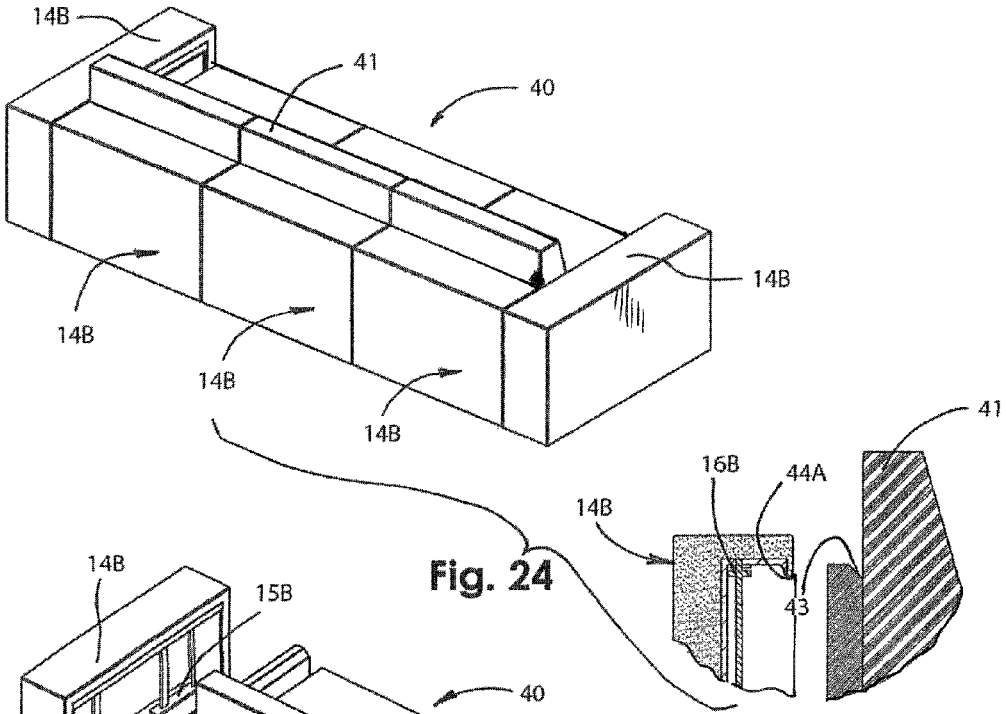
FIG. 24 is a composite perspective and enlarged partial view of a cushion seat sofa with alternate attached configurations.
Figure 25:
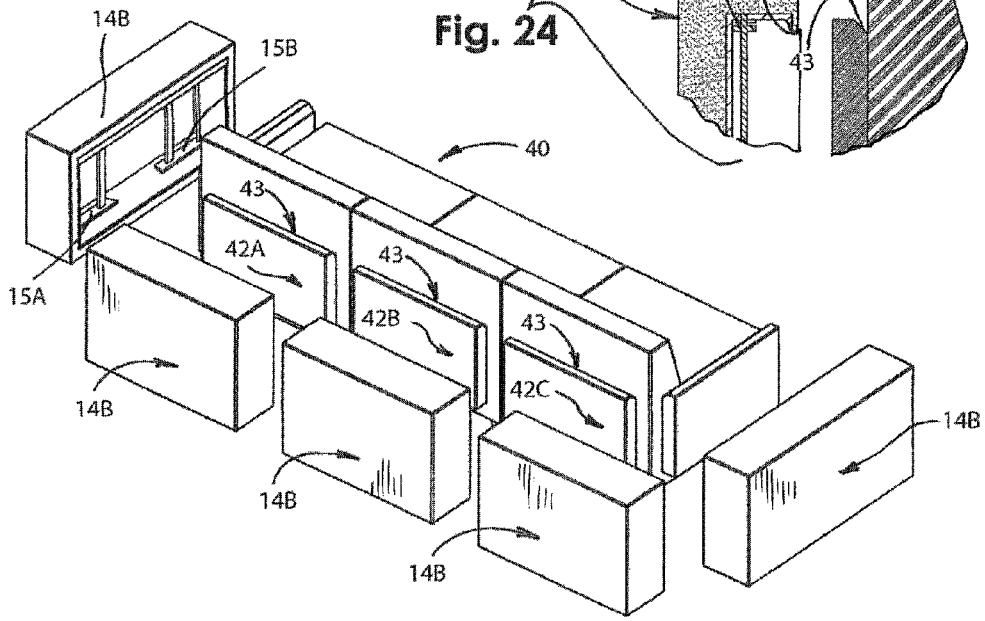
FIG. 25 is a back perspective view thereof with cushion seats removed in exploded illustration orientation.

An alternate cushion seat attachment at 40 can be seen in FIG. 24 of the drawings and composite perspective FIG. 25. It can be seen that a sofa back 41 has multiple retaining elements 42A, 42B and 42C, each of which has a beveled top edge portion 43 slanted inwardly. The respective modified cushion seats 14B have a corresponding inturned engagement edges at 44A which will be registerably engaged with the sofa back 41 retaining elements 42A, 42B and 42C thus hanging cushion seats 14B thereon as seen in FIG. 24 of the drawings or removed for deployment as illustrated in FIG. 25 of the drawings.

It will be evident from the foregoing descriptions that a variety of interengaging removable and deployable furniture seat configurations can be achieved by the hereinbefore described multiple chair sofa seat configurations 14 and 36 of the invention. Its compact self-contained furniture configurations will maximize the space by allowing user arrangement by providing a number of seating use configurations available to the user by the stored and deployable multiple cushion seat configurations acting as harms and backs to either sofas or chairs.

It will thus be seen that a new and novel chair/sofa multiple cushion seat integrated component configuration of unique storage utilization furniture has been illustrated and described and it will be apparent to those skilled in the art that various changes and modifications may be made therein without departing therefrom.

Therefore I claim:

1. Convertible furniture configurations comprising, a furnishing base have a seat cushion, an upstanding back cushion and a pair of oppositely disposed spaced arm support frames, and cushion side arm assemblies, said cushion side arm assemblies comprises, a cushion seat removably registerable on said respective arm support frames, said cushion seat comprising, a cushion frame, a cushion overlying said cushion frame, and a pair of leg assemblies secured to said cushion frame in oppositely relation to said respective arm support frames.

2. The convertible furniture set forth in claim 1 wherein said leg assemblies comprises, pairs of leg elements, a cross support interconnecting said respective leg elements, said leg assemblies pivotally secured to said cushion frame movable from a first folded position to a second deployed extended ground engagement position.

3. The convertible furniture configuration set forth in claim 1 further comprises, a back support frame on said upstanding back cushion, a cushion seat back assembly removably registerable on said back support frame, said cushion seat back assembly comprising, a frame, a cushion overlying said frame, pairs of leg assemblies pivotally secured to said frame in spaced oppositely disposed relation to one another.

4. The convertible furniture configuration set forth in claim 1 further comprises, oppositely disposed side arm frames, a pair of independent cushion seat assemblies positioned within each of said respective side arm frames.

5. The convertible furniture configuration set forth in claim 4 wherein said side arm frames comprises, a horizontally disposed channel member, said independent cushion seat assemblies slidably disposed within said respective channel members.

6. The convertible furniture configuration set forth in claim 4 wherein said independent cushion seat assemblies comprises, a frame, a cushion overlying said frame, pairs of hinge leg assemblies pivotally secured.

7. The convertible furniture configuration set forth in claim 4 wherein said, oppositely disposed side arm frames further comprise, a hinged shelf within each of said side arm frames.

8. The convertible furniture configuration set forth in claim 1 further comprises, pairs of arm support frames slidably disposed to one another and in spaced arm support frame relation to said seat cushion, pairs of cushion side arm assemblies removably positioned on said respective slidably disposed arm support frames, leg assemblies pivotally secured within each and to each of said respective cushion side arm assemblies.

9. A convertible sofa furniture configuration comprising, a sofa base having at least one seat cushion, at least one back cushion, a pair of oppositely disposed arm support frames and back support frames extending therebetween, removable cushion side arm assemblies and cushion back assemblies registerable within said respective arm support frames and back support frames, said cushion side arm assemblies and cushion back assemblies having respective pairs of leg support assemblies pivotally secured therewithin.

10. The convertible sofa furniture configuration set forth in claim 9 wherein said arm support frames and said back support frames have hinged shelves therewithin.

11. The convertible sofa furniture configuration set forth in claim 9 wherein said leg support assemblies comprise, pairs of pivoted leg elements movable from a first position within said respective cushion side arm assemblies and said cushion back assemblies to a second ground engagement deployed position.

12. The convertible sofa furniture configuration set forth in claim 9 wherein said arm support frames and said back support frames further comprise, a retaining element having a beveled top edge engagement portion, said cushion seat side arm assemblies and said cushion seat back assemblies have a corresponding registered inturned engagement edges for engagement therebetween and thereover retaining said respective cushion seats assemblies thereon.

* * * * *